US008280277B2

(12) United States Patent
Ohba et al.

(10) Patent No.: US 8,280,277 B2
(45) Date of Patent: Oct. 2, 2012

(54) HOUSING DEVICE AND IMAGE-FORMING APPARATUS

(75) Inventors: Shinichi Ohba, Saitama (JP); Jun Kawai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 177 days.

(21) Appl. No.: 12/835,990

(22) Filed: Jul. 14, 2010

(65) Prior Publication Data

US 2011/0064455 A1 Mar. 17, 2011

(30) Foreign Application Priority Data

Sep. 11, 2009 (JP) ..... 2009-210239

(51) Int. Cl.
*G03G 15/00* (2006.01)
*G03G 21/16* (2006.01)

(52) U.S. Cl. ..... 399/110; 399/107; 399/111

(58) Field of Classification Search ..... 399/107, 399/110, 111, 112
See application file for complete search history.

(56) References Cited

U.S. PATENT DOCUMENTS

| | | | | |
|---|---|---|---|---|
| 5,502,554 | A | 3/1996 | Hayashi et al. | |
| 7,139,507 | B2 * | 11/2006 | Sugimura et al. | 399/111 |
| 7,483,648 | B2 * | 1/2009 | Hosokawa et al. | 399/107 |
| 7,636,528 | B2 * | 12/2009 | Sato et al. | 399/107 |
| 2008/0124118 | A1 * | 5/2008 | Ukai et al. | 399/110 |
| 2011/0064458 | A1 * | 3/2011 | Kawai | 399/110 |

FOREIGN PATENT DOCUMENTS

| | | |
|---|---|---|
| JP | A-7-191556 | 7/1995 |
| JP | A-8-197790 | 8/1996 |
| JP | A-10-301421 | 11/1998 |

* cited by examiner

*Primary Examiner* — Sophia S Chen
(74) *Attorney, Agent, or Firm* — Oliff & Berridge, PLC

(57) ABSTRACT

A housing device includes: a housing that has an opening and defines a containment space for containing an object inserted through the opening; a guide member that has a longitudinal direction aligned with a direction of insertion of the object with respect to the housing and guides the object when the object is inserted into the containment space; a support structure that supports the guide member to be moveable with respect to the housing in the longitudinal direction; and a cover that opens and closes the opening, wherein when the cover closes the opening, the cover supports the object such that the object is spaced apart from the guide member.

11 Claims, 10 Drawing Sheets

HOUSING DEVICE AND IMAGE-FORMING APPARATUS

CROSS-REFERENCE TO RELATED APPLICATIONS

This application is based on and claims priority under 35 U.S.C. 119 from Japanese Patent Application No. 2009-210239, which was filed on Sep. 11, 2009.

BACKGROUND

1. Technical Field

The present invention relates to a housing device and an image-forming apparatus.

2. Related Art

Some housings are provided with a guide member for guiding an object being inserted into the housing along a direction of insertion. In a case where each end of the guide member is fixed to a corresponding frame of the housing and where the housing and the guide member are made of respective materials having different coefficients of thermal expansion, a change in temperature can cause deformation of the housing or the guide member.

SUMMARY

In one aspect of the present invention, there is provided a housing device including: a housing that has an opening and defines a containment space for containing an object inserted through the opening; a guide member that has a longitudinal direction aligned with a direction of insertion of the object with respect to the housing and guides the object when the object is inserted into the containment space; a support structure that supports the guide member to be moveable with respect to the housing in the longitudinal direction; and a cover that opens and closes the opening, wherein when the cover closes the opening, the cover supports the object such that the object is spaced apart from the guide member.

BRIEF DESCRIPTION OF THE DRAWINGS

Exemplary embodiments of the present invention will now be described in detail with reference to the following figures, wherein.

DETAILED DESCRIPTION

1. Exemplary Embodiment

Figure 1:
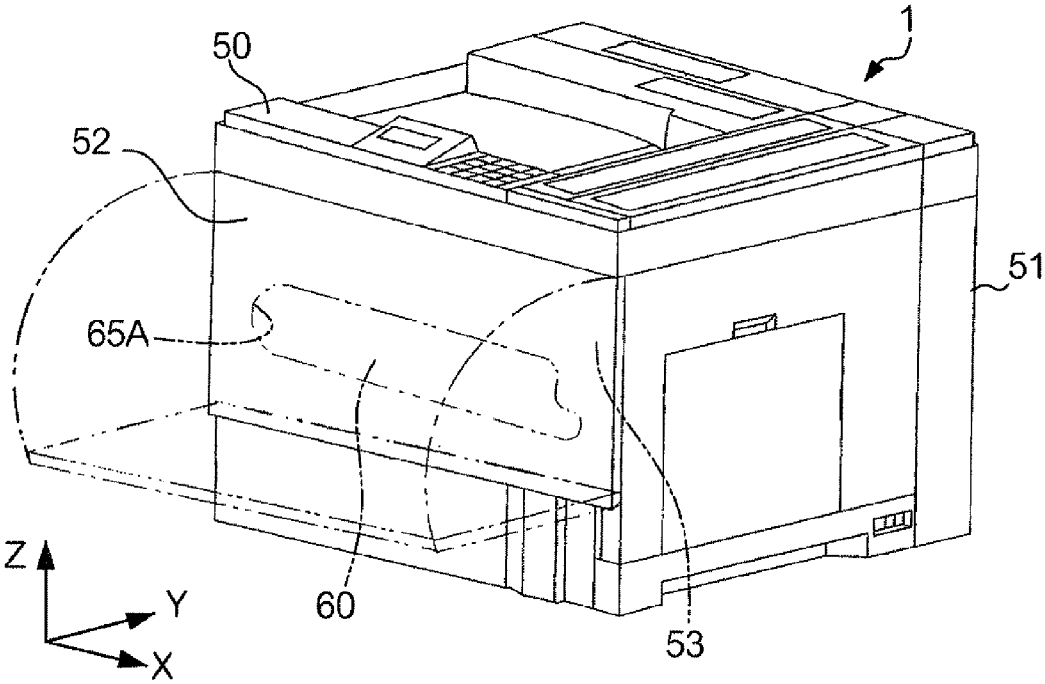
FIG. 1 is a perspective view showing an image-forming apparatus using a housing device according to an exemplary embodiment of the present invention.
Figure 2:
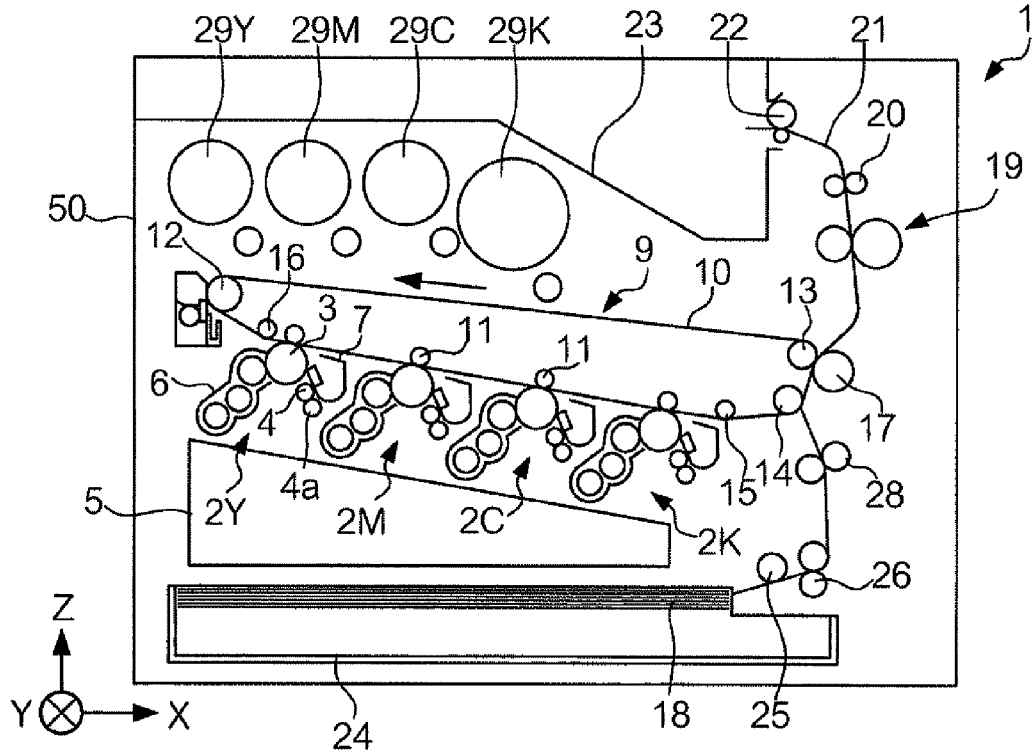
FIG. 2 is a schematic view showing a configuration of the image-forming apparatus.

An image-forming apparatus, such as a printer or a copy machine, is provided with a cover on a front or a lateral side of a housing, for example, in such a manner that the cover can be opened and closed to facilitate maintenance or replacement of a component part, or removal of a jammed sheet. In the following, taking such an image-forming apparatus as an example, explanation will be made of an exemplary embodiment of the present invention. FIG. 1 is a perspective view showing an outer appearance of an image-forming apparatus including a housing device according to the exemplary embodiment, and FIG. 2 schematically shows a configuration inside a housing of the image-forming apparatus.

<Configuration of Image-Forming Apparatus>

As shown in FIG. 1, an outer shape of image-forming apparatus 1 is formed by box-shaped housing device 50, and outer cover 52 is provided on a front of housing 51, which serves as a base of housing device 50, such that outer cover 52 can be opened and closed. When outer cover 52 is opened, front frame 53, which is provided with inner cover 60 that can be opened and closed and serves as a cover of opening 65A, is exposed to an outside.

In the following description, when image-forming apparatus 1 is viewed from its front by a user, the horizontal direction is denoted as the X-axis direction, the front-back direction is denoted as the Y-axis direction, and the vertical direction is denoted as the Z-axis direction. Also, "left" and "right" are indicated from the user's perspective.

Now, with reference to FIG. 2, explanation will be made of an example of an inner configuration and an operation of image-forming apparatus 1. Image-forming apparatus 1 is adapted to constitute a full-color printer of a tandem type, and contains an image-processing unit (not shown in the drawings) that performs image-processing on image data received from a device such as a scanner or a personal computer (not shown in the drawings), or received via a telephone line (not shown in the drawings), etc. Provided inside image-forming apparatus 1 are four image-forming units 2Y, 2M, 2C, 2K for yellow (Y), magenta (M), cyan (C), and black (K), respectively. Image-forming units 2Y, 2M, 2C, 2K are arranged generally in the horizontal direction so as to be spaced apart from each other and to extend in parallel, and vertical positions of image-forming units 2Y, 2M, 2C, 2K are respectively lower in this order (thus, the vertical position of image-forming unit 2Y is higher than that of image-forming unit 2K), whereby a plane in which image-forming units 2Y, 2M, 2C, 2K are arranged is inclined at a certain angle (e.g., 10 degrees) with respect to the horizontal direction. By this arrangement of image-forming units 2Y, 2M, 2C, 2K in a plane inclined at a certain angle with respect to the horizontal direction, the horizontal dimension is reduced in comparison with a case where image-forming units 2Y, 2M, 2C, 2K are arranged in a horizontal plane.

Each of the four image-forming units 2Y, 2M, 2C, 2K has basically the same structure, and contains photosensitive drum 3 that is driven to rotate at a certain speed by a drive unit (not shown in the drawings) and that serves as an image-holding member, primary charging roll 4 that charges a surface of photosensitive drum 3, developer unit 6 that develops, with toner, an electrostatic latent image formed on photosensitive drum 3 as a result of image exposure performed by image exposure unit 5 (described later), and cleaning unit 7 that cleans the surface of photosensitive drum 3. Photosensitive drum 3 is constituted, for example, of an organic photosensitive member having a cylindrical shape with a diameter of 30 mm, and having an overcoat layer on its surface. Photosensitive drum 3 is rotated by a drive motor (not shown in the drawings). Charging roll 4 is, for example, a roll-shaped charger constituted of a core bar coated with a conductive layer made of a synthetic resin or rubber and having an adjusted electric resistance, and a charging bias is applied to the core bar of charging roll 4. Further, cleaning roll 4*a* for removing foreign matter such as toner adhering to a surface of charging roll 4 is arranged to contact the surface of charging roll 4.

In the following description, where it is not necessary to distinguish between image-forming units 2Y, 2M, 2C, 2K, the image-forming units will be simply referred to as image-forming unit(s) 2.

Below image-forming units 2Y, 2M, 2C, 2K, exposure unit 5 is provided. Exposure unit 5 has four semiconductor laser units (not shown in the drawings) for emitting laser beams modulated in accordance with image data. The four laser beams emitted from these semiconductor laser units are deflected by a polygon mirror for scanning, and are irradiated onto photosensitive drum 3 of each image-forming unit 2Y, 2M, 2C, 2K via optical elements such as a lens and a mirror (not shown in the drawings).

In this exemplary embodiment, exposure unit 5 extends along an underside of the four image-forming units 2Y, 2M, 2C, 2K, which are arranged in a plane inclined with respect to the horizontal direction. Thus, a length of a light path of the laser beam irradiated onto photosensitive drum 3 is the same for each of image-forming units 2Y, 2M, 2C, and 2K.

Image exposure unit 5, which is provided in common to each image-forming unit 2Y, 2M, 2C, 2K, receives image data of respective colors sequentially from the image-processing unit. The laser beam emitted from image exposure unit 5 in accordance with the image data is irradiated onto a surface of corresponding photosensitive drum 3 to form an electrostatic latent image thereon. The electrostatic latent images formed on photosensitive drums 3 are developed by developer units 6Y, 6M, 6C, 6K to form toner images of respective colors. The toner images of respective colors formed sequentially on photosensitive drums 3 of image-forming units 2Y, 2M, 2C, 2K are transferred one on top of another by primary transfer rolls 11 to intermediate transfer belt 10, which is arranged obliquely over the top of each image-forming unit 2Y, 2M, 2C, 2K, and serves as an intermediate transfer member.

Intermediate transfer belt 10 is an endless belt-shaped member tension-supported by multiple rolls. Specifically, intermediate transfer belt 10 is wound around tension roll 12, drive roll 13, backup roll 14, first idler roll 15, and second idler roll 16, such that intermediate transfer belt 10 is circulatingly moved in a direction indicated by an arrow in FIG. 2 by drive roll 13, which is rotated by a dedicated drive motor (not shown in the drawings) capable of maintaining a constant rotation speed. Intermediate transfer belt 10 has an upper moving section and a lower moving section, and the lower moving section is inclined with respect to the horizontal direction, with a downstream end of the lower moving section positioned lower than an upstream end of the same with respect to the direction of movement of the lower moving section. As intermediate transfer belt 10, a flexible film made of a synthetic resin, such as polyimide, may be used, where the ends of the synthetic resin film are connected by means of welding or the like to form an endless belt member. Intermediate transfer belt 10 is arranged such that the lower moving section is in contact with photosensitive drums 3Y, 3M, 3C, 3K of image-forming units 2Y, 2M, 2C, 2K.

It is to be noted that intermediate transfer belt 10, primary transfer rolls 11, tension roll 12, drive roll 13, backup roll 14, first idler roll 15, second idler roll 16, etc., are integrated into a single unit referred to as intermediate transfer unit 9.

At a position that is opposed to drive roll 13 across intermediate transfer belt 10 is provided secondary transfer roll 17, which is urged against intermediate transfer belt 10. Secondary transfer roll 17 functions to secondarily-transfer the toner images, which have been primarily-transferred onto intermediate transfer belt 10, onto recording sheet 18. When recording sheet 18 moves between secondary transfer roll 17 and intermediate transfer belt 10, secondary transfer roll 17 presses recording sheet 18 against intermediate transfer belt 10, whereby the toner images of yellow (Y), magenta (M), cyan (C), and black (K), which have been overlappingly transferred onto intermediate transfer belt 10, are transferred onto recording sheet 18 owing to pressure and electrostatic force. Recording sheet 18, on which the toner images of respective colors have been transferred, is conveyed to fixing unit 19 positioned above.

Fixing unit 19 applies heat and pressure to recording sheet 18 to fix the toner images on recording sheet 18. Thereafter, recording sheet 18 passes through exit roll 20 of fixing unit 19 and sheet discharge path 21, and is discharged by discharge roll 22 onto sheet-receiving tray 23 provided at an upper portion of image-forming apparatus 1.

Recording sheets 18, having a prescribed size and being made of a prescribed material, and serving as recording media, are contained in sheet container 24 disposed inside image-forming apparatus 1. Recording sheets 18 are conveyed from sheet container 24, one sheet at a time, by means of sheet supply roll 25 and a pair of rolls 26 for sheet separation and conveyance to registration roll 28, and are temporarily stopped there. Then, recording sheet 18 is further conveyed to a secondary transfer position of intermediate transfer belt 10 by registration roll 28, which is rotated at a predetermined timing.

Arranged between sheet-receiving tray 23 and intermediate transfer belt 10 are toner cartridges 29Y, 29M, 29C, 29K. Toner cartridges 29Y, 29M, 29C, and 29K supply toner to developer units 6Y, 6M, 6C, and 6K, respectively. Toner cartridge 29K containing toner of black (K) is larger than the toner cartridges of the other colors because black toner is used more frequently than any other toner.

<Configuration of Housing Device>

Next, with reference to FIGS. 1, and 3-5, explanation will be made of a configuration of housing device 50.

Figure 3:
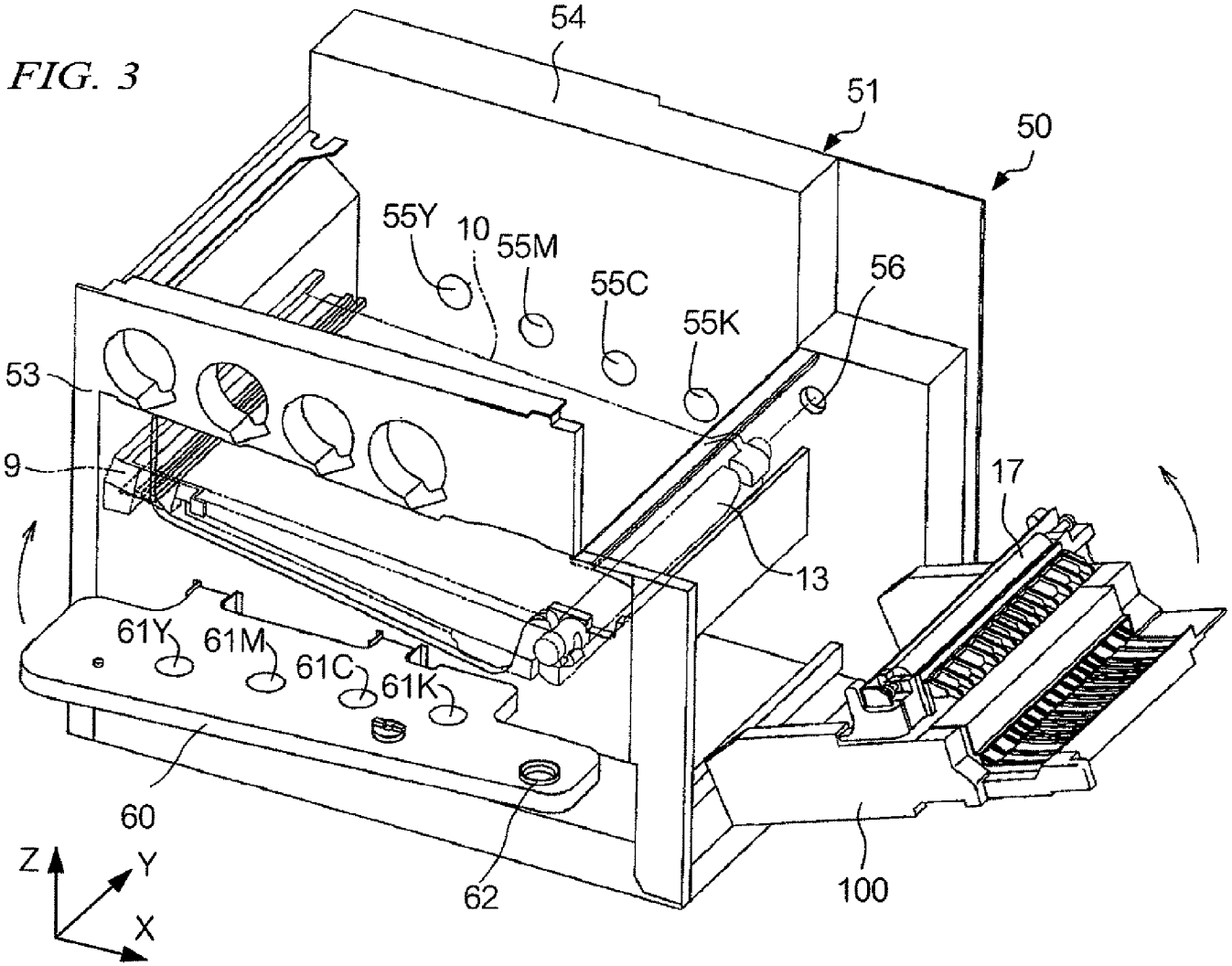
FIG. 3 is a perspective view showing a configuration of the housing device.
Figure 4:
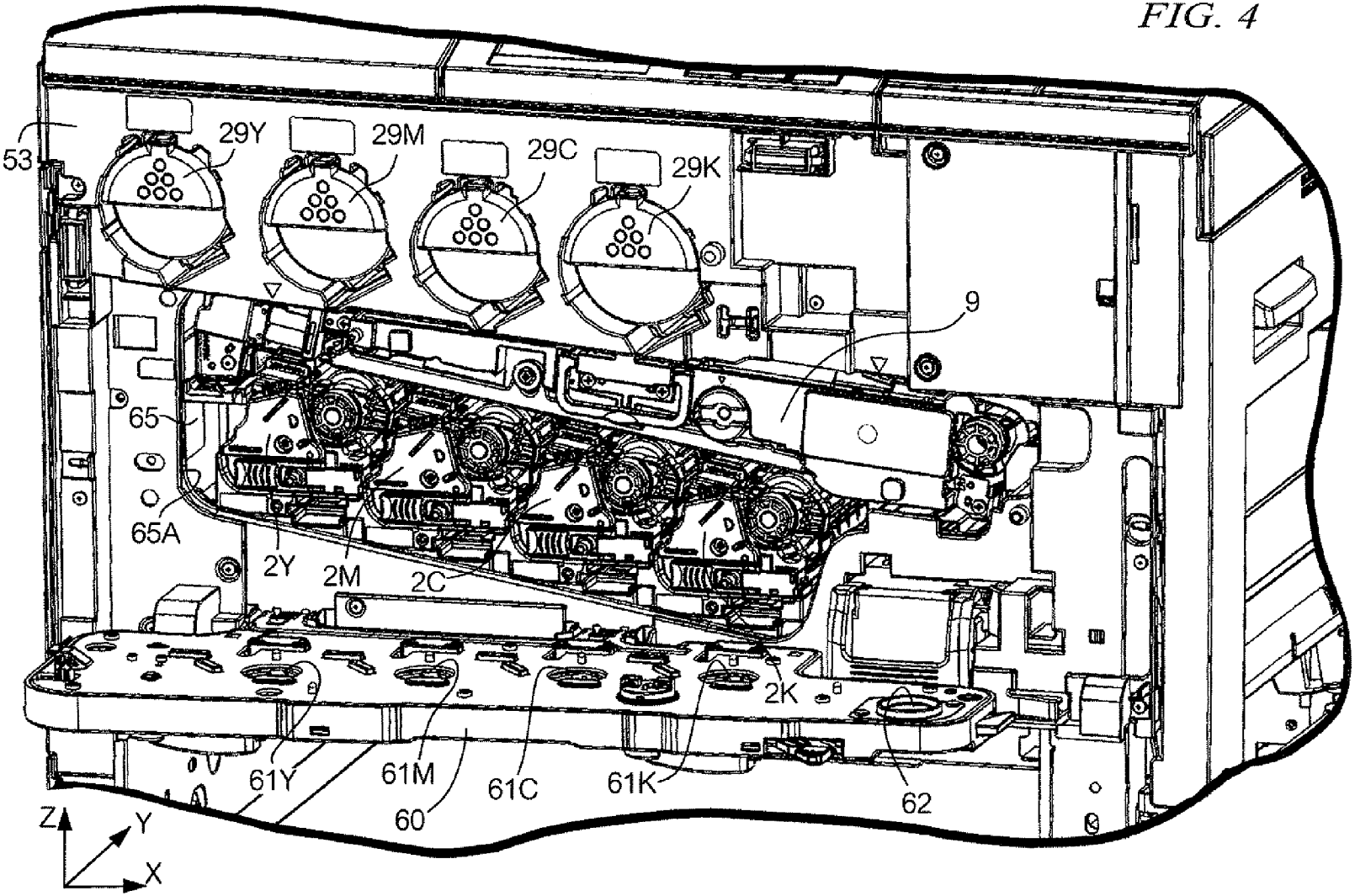
FIG. 4 is a perspective view showing a state where an outer cover and an inner cover are opened.
Figure 5:
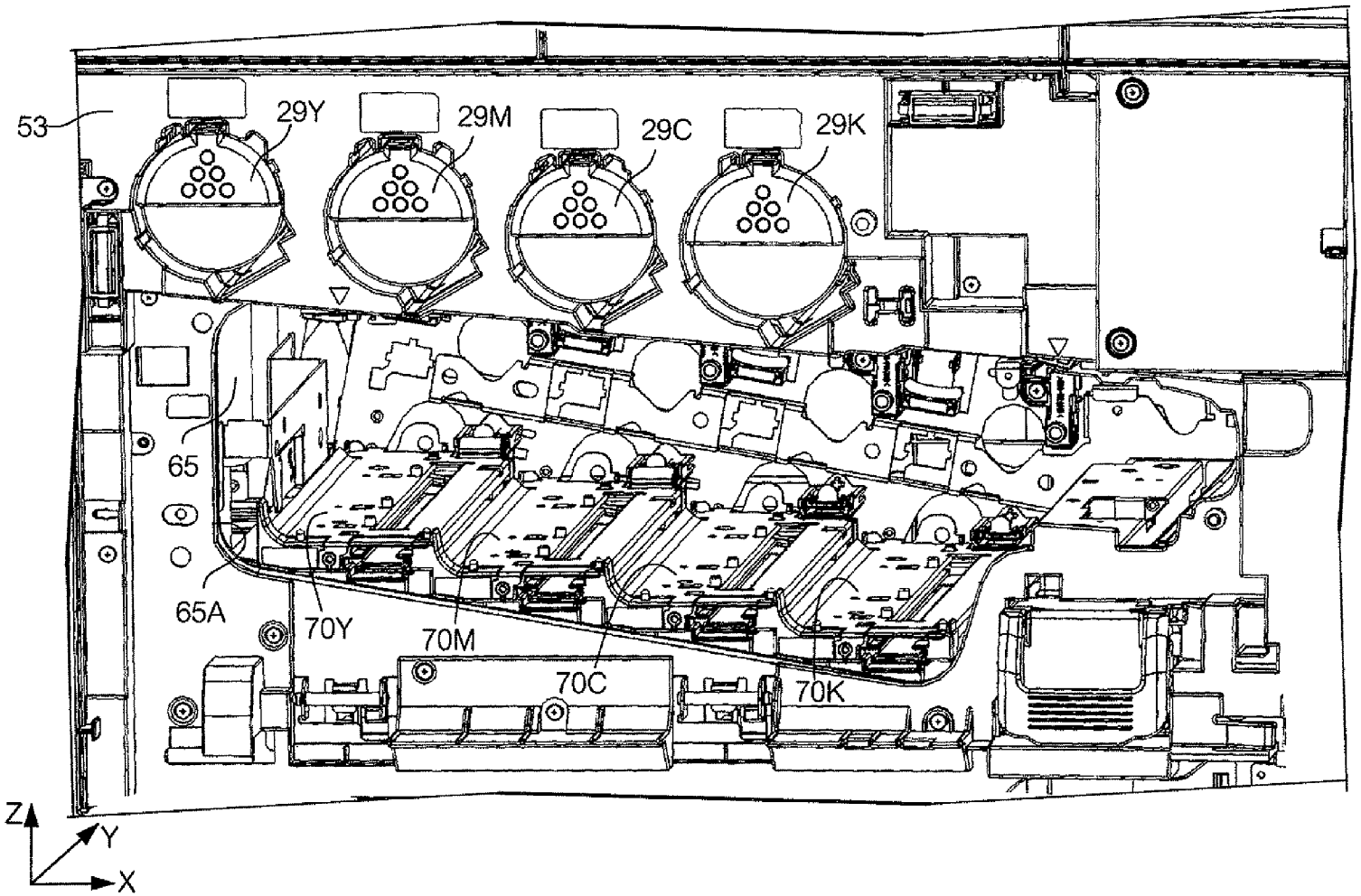
FIG. 5 is a perspective view showing a state where image-forming units are removed from the state shown in FIG. 4.

FIG. 3 is a schematic view showing a configuration of housing device 50, FIG. 4 is a perspective view showing a state where the outer cover and the inner cover are opened, and FIG. 5 is a perspective view showing a state where image-forming units are removed from the state shown in FIG. 4.

As shown in FIG. 1, when outer cover 52 on the front of housing 51 is opened, front frame 53 is exposed. Toner cartridges 29Y, 29M, 29C, and 29K, intermediate transfer unit 9, etc. are detachably attached to front frame 53. Front frame 53 is also provided with inner cover 60 that can be opened and closed.

FIG. 3 shows a state where exterior members covering housing device 50 have been removed. On a right side of housing 51 is provided a side cover 100 that can be opened and closed. Second transfer roll 17 is provided on an inner side of side cover 100 such that when side cover 100 is closed, second transfer roll 17 is elastically pressed against drive roll 13 via intermediate transfer belt 10 therebetween.

Back frame 54 is disposed on a back side of housing 51 so as to be opposed to front frame 53. Between front frame 53 and back frame 54 is defined a space in which intermediate transfer unit 9, image-forming units 2, toner cartridges 29, etc. are arranged.

As shown in FIG. 3, formed on an inner side of inner cover 60 are four shaft-supporting parts 61Y, 61M, 61C, and 61K for supporting ends of rotation shafts of photosensitive drums 3 included in image-forming units 2Y, 2M, 2C, and 2K, respectively, and roll-supporting part 62 for supporting an end of drive roll 13 of intermediate transfer unit 9.

Further, on an inner side of back frame 54 are formed four shaft-supporting parts 55Y, 55M, 55C, and 55K for supporting the other ends of the rotation shafts of respective photosensitive drums 3, and roll-supporting part 56 for supporting the other end of drive roll 13 of intermediate transfer unit 9.

It is to be noted here that in housing 51, a direction from the front side (a first side) to the back side (a second side opposed to the first side) along the Y-axis is a direction of insertion of image-forming units 2Y, 2M, 2C, 2K, toner cartridges 29Y, 29M, 29C, 29K, intermediate transfer unit 9, etc.

As shown in FIG. 4, when inner cover 60 is opened, image-forming units 2Y, 2M, 2C, 2K contained in containment space 65 are exposed. Further, as shown in FIG. 5, when image-forming units 2Y, 2M, 2C, 2K and intermediate transfer unit 9 are removed, containment space 65, which has opening 65A, and guide members 70Y, 70M, 70C, 70K provided in containment space 65 are exposed.

Containment space 65 and its opening 65A have a rectangular shape elongated generally in the horizontal direction, and a bottom side thereof is inclined such that a right portion is lower than a left portion, in conformity with an inclination of an upper side of image exposure unit 5. Guide members 70Y, 70M, 70C, and 70K for containment of image-forming units 2Y, 2M, 2C, and 2K, respectively, are provided at the bottom of containment space 65 so as to be positioned respectively lower in this order in a step-like manner.

In the following description, where it is not necessary to distinguish between guide members 70Y, 70M, 70C, 70K, the guide members will be simply referred to as guide member(s) 70.

<Configuration of Guide Member>

Figure 6:
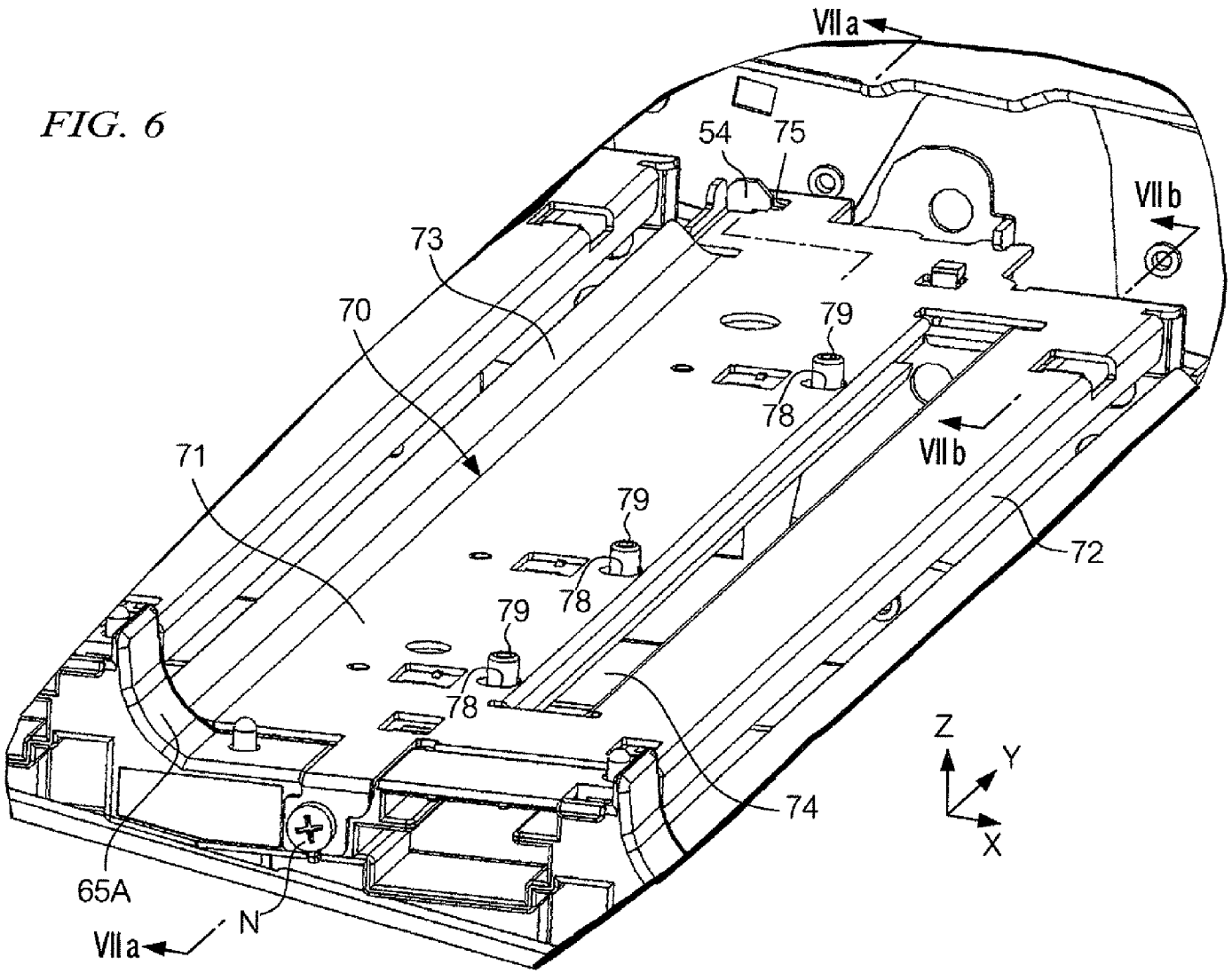
FIG. 6 is an enlarged perspective view of a guide member shown in FIG. 5.
Figure 8:
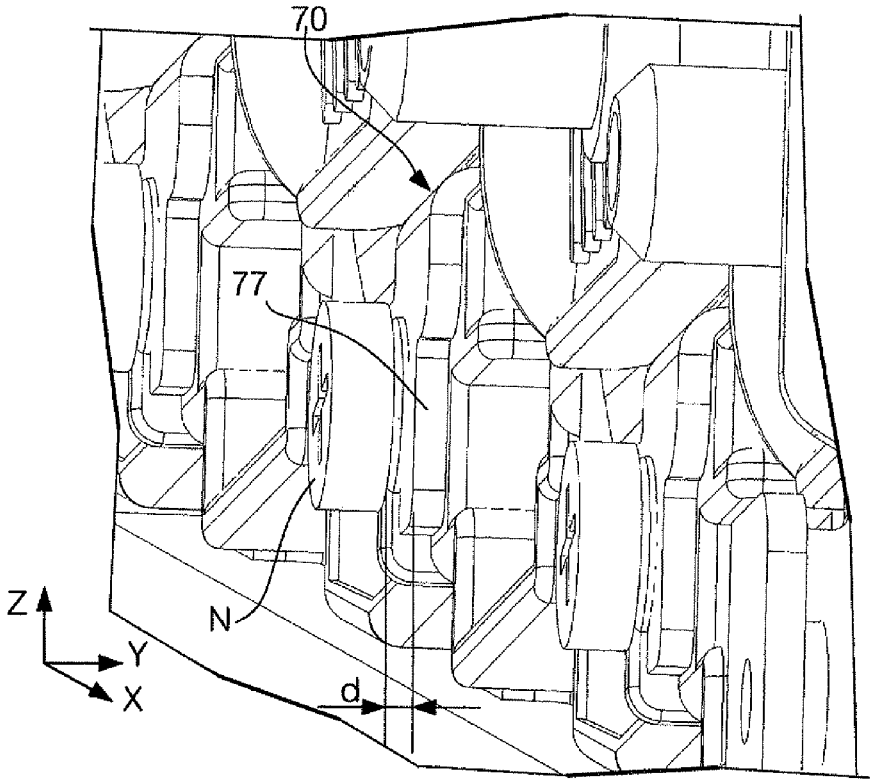
FIG. 8 is a perspective view showing an essential part of FIG. 6 viewed in a different direction.
Figure 9:
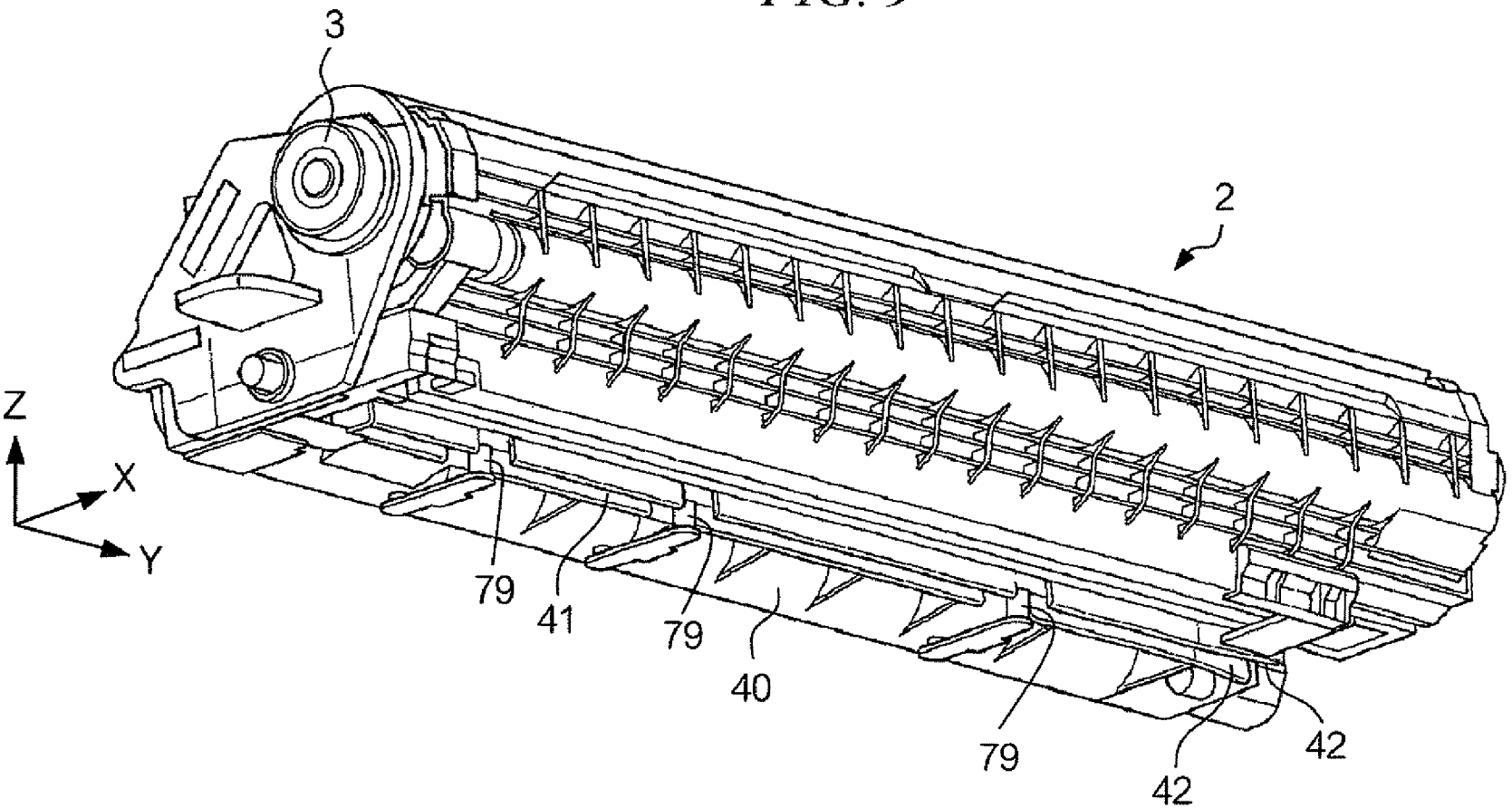
FIG. 9 is a perspective view showing an image-forming unit and guide pins.
Figure 10:
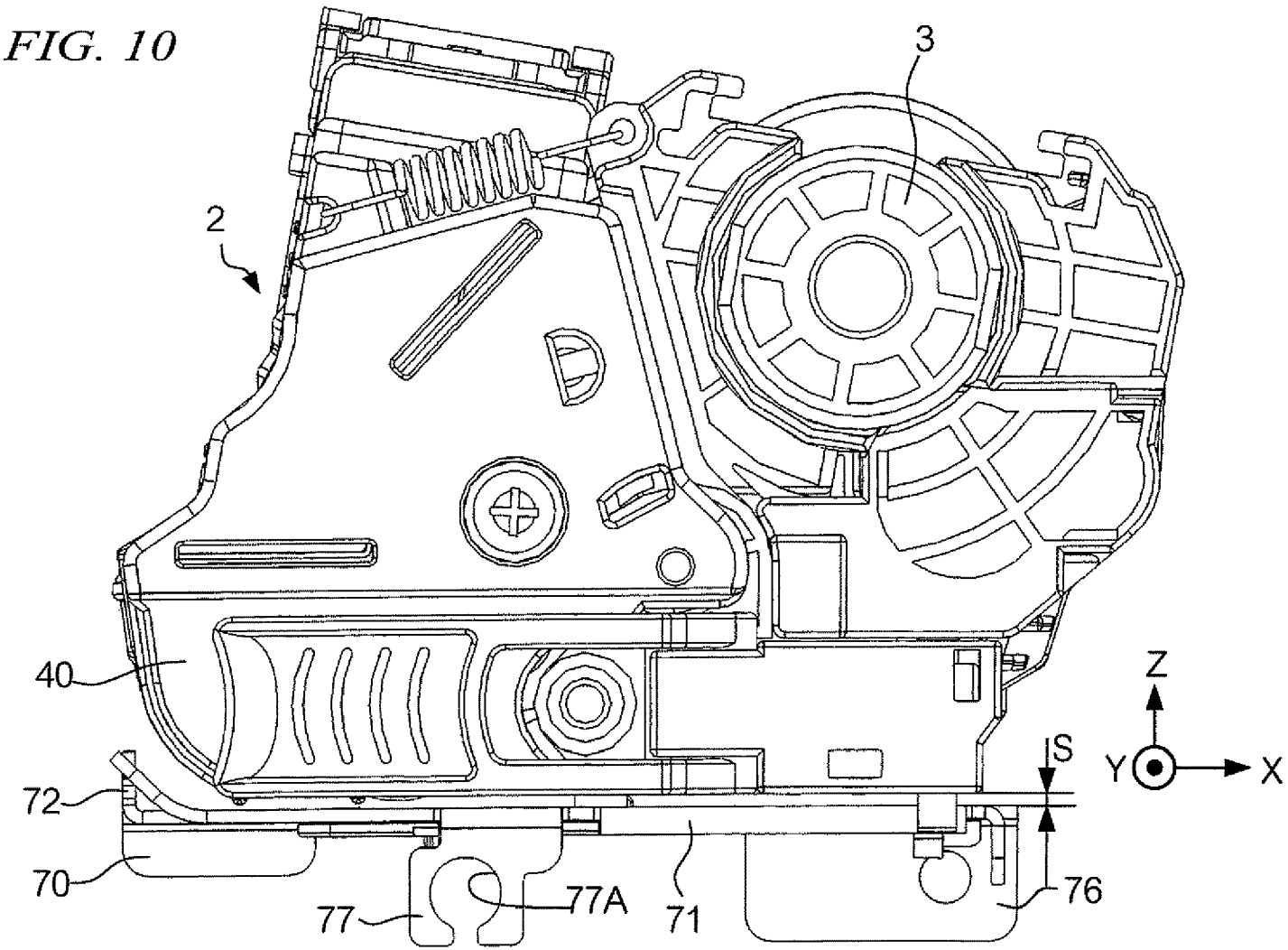
FIG. 10 is a view showing a relationship between an image-forming unit and a guide member in a state where the image-forming unit has been inserted into a housing.

Next, with reference to FIGS. 6-10, a configuration of guide member 70 will be explained. FIG. 6 is an enlarged perspective view of a guide member shown in FIG. 5, FIGS. 7A and 7B are cross-sectional views taken along line VIIa-VIIa and line VIIb-VIIb respectively shown in FIG. 6, FIG. 8 is a perspective view concretely showing an essential part of FIG. 6, FIG. 9 is a perspective view showing an image-forming unit and guide pins, and FIG. 10 is a view showing a relationship between an image-forming unit and a guide member in a state where the image-forming unit has been inserted into the housing.

As shown in FIG. 6, rectangular plate member 71 extending along the direction of insertion constitutes a main portion of guide member 70, and a longer side of plate member 71 on the right is bent downward to form rib 72 extending in the longitudinal direction, while a longer side of plate member 71 on the left is curved upward to form raised portion 73 extending in the longitudinal direction and having an arcuate cross-section. Also, window 74 through which the laser beam emitted from image exposure unit 5 passes is formed along the longitudinal direction of plate member 71.

In a back end portion of plate member 71, to securely engage with back frame 54, engagement groove 75 extending along the X-axis direction and opening in the leftward direction and bent portion 76 that is bent downward (see FIG. 7B) are formed. On the other hand, in a front end portion of plate member 71, bent portion 77 having screw insertion hole 77A in its central part is formed. This bent portion 77 extends to an outer side of front frame 53 to engage with front frame 53. Screw N inserted into screw insertion hole 77A of bent portion 77 is screwed into screw hole 53A formed in front frame 53. Screw insertion hole 77A and screw hole 53A are formed to extend along the direction of insertion. Screw N has shaft portion N2 formed with male threads, and head portion N1 provided at one end of shaft portion N2 and having a larger diameter than shaft portion N2.

Figure 7A:
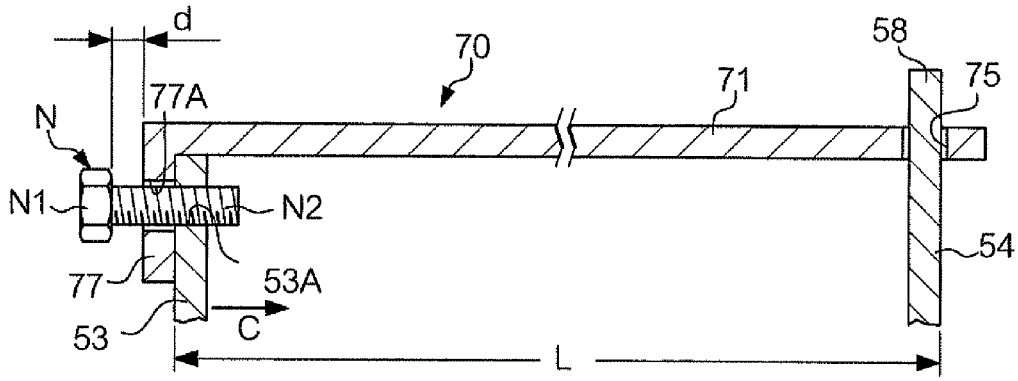
FIGS. 7A and 7B are cross-sectional views taken along line VIIa-VIIa and line VIIb-VIIb, respectively, in FIG. 6.
Figure 7A:
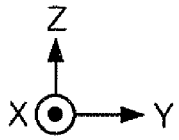
Figure 7B:
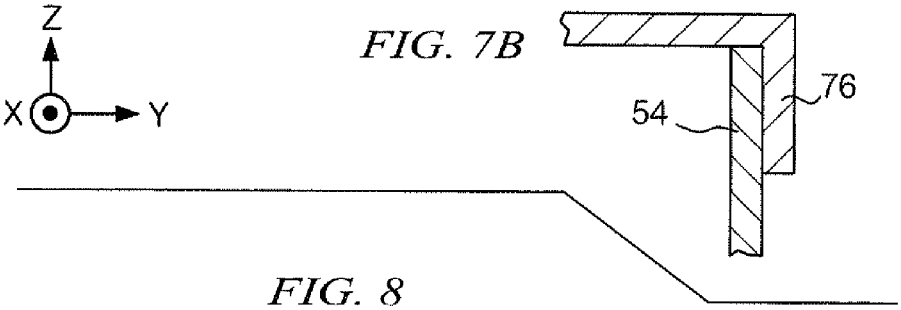

As shown in FIG. 6 and FIG. 7A, engagement groove 75 of guide member 70 engages with plate-shaped engagement portion 58, which is formed in back frame 54 to extend in the X-axis direction. In this exemplary embodiment, bent portion 76 engaging with back frame 54 constitutes an attachment member, and a back portion of guide member 70 is attached to back frame 54 such that its movement is restricted in the X, Y, and Z-axis directions.

On the other hand, bent portion 77 provided to guide member 70 on a side close to opening 65A (i.e., on a front side in FIG. 6) is constituted of one end portion of plate member 71 in a longitudinal direction that is bent to extend in a direction intersecting with the longitudinal direction. Bent portion 77 has screw insertion hole 77A into which shaft portion N2 of screw N is inserted. As shown in FIG. 7A, bent portion 77 is attached to front frame 53 by screw N inserted into screw insertion hole 77A. Thus, guide member 70 is attached to housing 51 at three positions; two in the back portion and one in the front portion. It is also to be noted that an operation for tightening screw N on the front side in a state that inner cover 60 is opened can be carried out more easily compared to an operation for tightening a screw on any other side.

In the present exemplary embodiment, as shown in FIGS. 7A and 8, shaft portion N2 of screw N is inserted into screw insertion hole 77A and screw hole 53A in this order, with bent portion 77 being aligned with front frame 53, and is screwed into screw hole 53A such that head portion N1 is spaced apart from bent portion 77 by distance d. Thus, a support structure in this exemplary embodiment is configured such that screw N is fixed with head portion N1 being spaced apart from bent portion 77 by distance d.

Further, guide member 70 is formed with round holes 78 adjacent to window 74, and guide pins 79 protrude through these round holes 78. The plural (three in this exemplary embodiment) guide pins 79 are arranged along the direction of insertion (in the Y-axis direction), and a distance between first guide pin 79 (from the front side) and second guide pin 79 is shorter than a distance between second guide pin 79 and third guide pine 79.

As shown in FIG. 9, bottom member 40 of image-forming unit 2 is provided with concave guide groove 41 extending in a direction of installment/removal of image-forming unit 2 (in the Y-axis direction). When image-forming unit 2 is installed, guide groove 41 is guided by guide pins 79 provided to housing 51, whereby image-forming unit 2 can be installed and removed with respect to housing device 50 along the Y-axis. In a back end portion of guide groove 41, diverging portions 42, 42 are formed to easily receive guide pins 79 when image-forming unit 2 is installed into housing device 50.

When image-forming unit 2 is inserted along the direction of insertion, bottom member 40 of image-forming unit 2 is moved along raised portion 73 of guide member 70 such that diverging portions 42, 42 of guide groove 41 receive guide pins 79 sequentially and guide groove 41 slidably engages with guide pins 79. In this way, image-forming unit 2 is installed into containment space 65.

After the insertion of image-forming unit 2 into containment space 65, when inner cover 60 is closed, one end of photosensitive drum 3 of image-forming unit 2 is supported by shaft-supporting part 61 of inner cover 60 and the other end of the same is supported by shaft-supporting part 55 of back frame 54, such that image-forming unit 2 is supported to be spaced apart from guide member 70 by clearance S, as shown in FIG. 10.

The reason for the provision of clearance S is that if guide member 70 were in contact with image-forming unit 2, a pressing force resulting from the contact could cause a casing or a shaft of image-forming unit 2 to be deformed. If varying deformations are caused to image-forming units 2Y, 2M, 2C and 2K, misalignment of toner images transferred onto intermediate transfer belt 10 can result. Thus, clearance S contributes to avoiding problems that may occur as a result of contact between guide member 70 and image-forming unit 2.

Operation of the Exemplary Embodiment

In image-forming apparatus 1 according to the exemplary embodiment, when image-forming apparatus 1 is placed on a non-horizontal surface, deformation may be caused to housing device 50 such that distance L between front frame 53 and back frame 54 is decreased. Also, when deformation is caused to housing device 50 due to an external impact or vibration, distance L between front frame 53 and back frame 54 can decrease. In such cases, if the ends of the guide member were fixed to frames 53 and 54 by means of screws or the like, the guide member could warp inwardly to contact image-forming unit 2.

To avoid such a problem, in the present exemplary embodiment, distance d is provided between head portion N1 of screw N and bent portion 77 as shown in FIG. 7A. Therefore, even if distance L between frames 53, 54 decreases and front frame 53 moves in a direction indicated by arrow C, shaft portion N2 slides in screw insertion hole 77A to absorb the effect of deformation of housing 51, thereby preventing warp of guide member 70. Thus, problems such as misalignment of toner images caused by contact between guide member 70 and image-forming unit 2 are less likely to occur.

<Modified Embodiments>

The present invention is not limited to the aforementioned exemplary embodiment, and support structures as described in the following modified embodiments may be utilized.

<2-1>

In the exemplary embodiment, head portion N1 of screw N is spaced apart from bent portion 77 to create distance d. However, the present invention is not limited to such a configuration, and configurations as shown in FIGS. 11A, 11B, 12A, and 12B may be used.

Figure 11A:
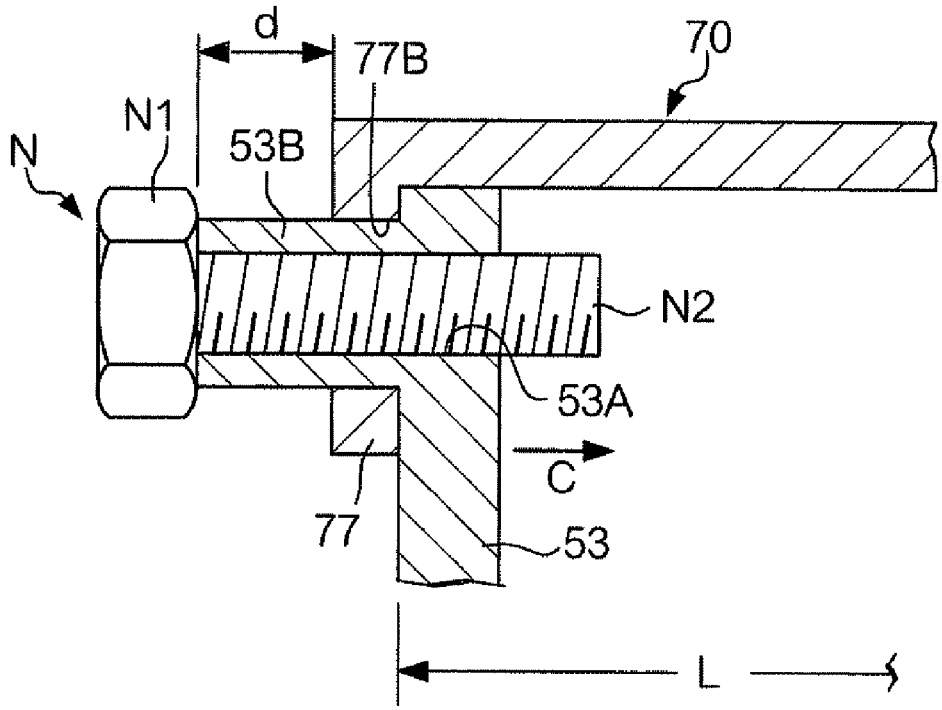
FIGS. 11A and 11B are cross-sectional views showing a relationship between a guide member and a frame in modified embodiments.

In a support structure shown in FIG. 11A, boss portion 53B is formed to protrude outwardly from a portion of front frame 53 surrounding screw hole 53A, and boss insertion hole 77B is formed in bent portion 77 of guide member 70. These boss portion 53B and boss insertion hole 77B are formed to extend along the direction of insertion.

Figure 11B:
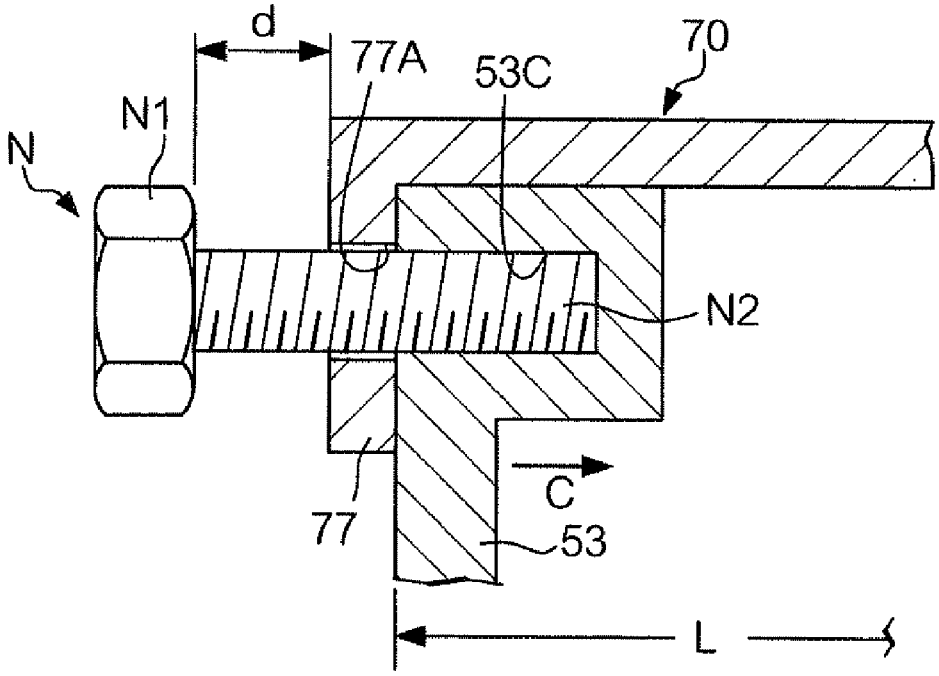

In a support structure shown in FIG. 11B, screw hole 53C having a bottom is formed in front frame 53, and screw insertion hole 77A is formed in bent portion 77 of guide member 70. This screw hole 53C and screw insertion hole 77A are formed along the direction of insertion.

The support structures shown in FIGS. 11A and 11B operate in a similar manner and exert similar effects to those of the support structure shown in the exemplary embodiment. Further, screw N is fixed with head portion N1 being in contact with an end of boss portion 53B in the support structure shown in FIG. 11A, and screw N is fixed with an end of shaft portion N2 being in contact with a bottom of screw hole 53C in the support structure shown in FIG. 11B, and thus loosening of screw N is less likely to occur than in the exemplary embodiment.

Figure 12A:
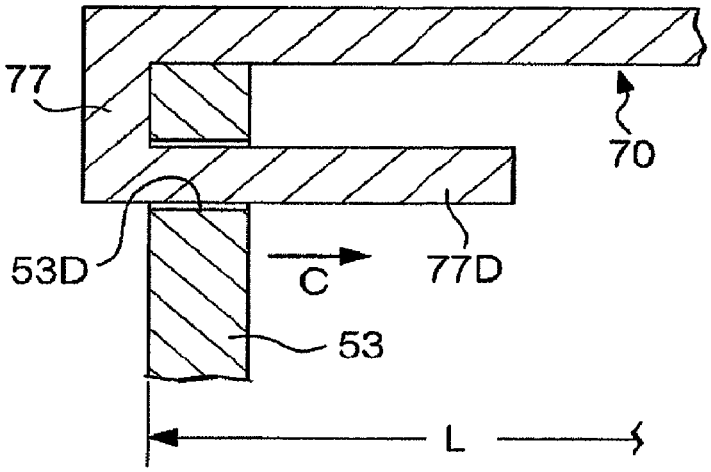
FIGS. 12A and 12B are cross-sectional views showing a relationship between a guide member and a frame in modified embodiments.

In a support structure shown in FIG. 12A, insertion hole 53D extending along the direction of insertion is formed in front frame 53, and engagement protrusion 77D extending along the direction of insertion and inserted into insertion hole 53D is formed at an end of bent portion 77 of guide member 70.

Figure 12B:
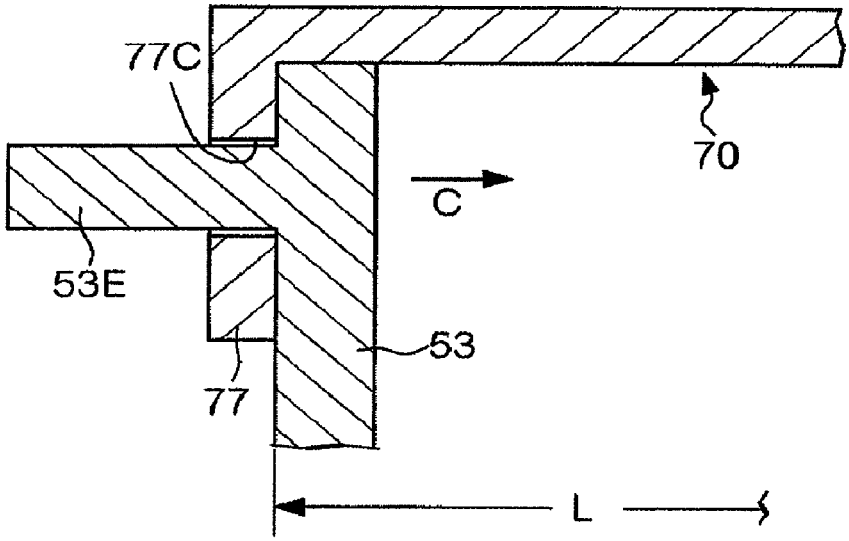

In a support structure shown in FIG. 12B, engagement protrusion 53E extending outwardly along the direction of insertion is formed on front frame 53, and insertion hole 77C extending along the direction of insertion to receive engagement protrusion 53E is formed in bent portion 77 of guide member 70.

In the support structures shown in FIGS. 12A and 12B, when distance L between frames 53 and 54 decreases and front frame 53 moves in the direction indicated by arrow C, the influence is absorbed by the support structures and thus warp of guide member 70 is prevented. Further, because screw N is not used, unlike the support structure shown in the exemplary embodiment or shown in FIGS. 11A and 11B, a number of components included is less than the number used in the exemplary embodiment.

Any other support structure having a different configuration from those described in the foregoing may be adopted, so long as the support structure can prevent an influence of a decrease in the distance between frames 53 and 54 and movement of front frame 53 in the direction indicated by arrow C from being transmitted to guide member 70.

<2-2>

In the exemplary embodiment, image-forming unit 2 is illustrated as an object. However, the object may be another unit.

<2-3>

In the exemplary embodiment, housing device 50 is used to constitute image-forming apparatus 1. However, the present invention is not limited to such an embodiment, and may be applied to any other apparatus.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A housing device comprising:

a housing that has an opening and defines a containment space for containing an object inserted through the opening;

a guide member that has a longitudinal direction aligned with a direction of insertion of the object with respect to the housing and guides the object when the object is inserted into the containment space;

a support structure that supports the guide member to be moveable with respect to the housing in the longitudinal direction; and a cover that opens and closes the opening, wherein once the cover has closed the opening, the cover supports the object such that the object is spaced apart from the guide member.

2. The housing device according to claim 1, wherein the support structure includes:

a screw having a shaft portion formed with male threads and a head portion provided at one end of the shaft portion, the head portion having a larger diameter than the shaft portion;

a screw hole provided on a side of the housing on which the opening is provided, the screw hole extending along the direction of insertion and having an inner surface formed with female threads; and a bent portion constituted of one end portion of the guide member in the longitudinal direction that is bent to extend in a direction intersecting with the longitudinal direction, the bent portion having a screw insertion hole into which the shaft portion of the screw is inserted, wherein the shaft portion of the screw is inserted into the screw insertion hole and the screw hole in this order to support the guide member, with the head portion of the screw being spaced apart from the bent portion.

3. An image-forming apparatus comprising:

the housing device according to claim 2;

an image-forming unit having an image-holding member on which an image is formed;

a transfer unit that transfers the image formed on the image-forming unit onto a recording medium; and a fixing unit that fixes the transferred image onto the recording medium, the image-forming unit, the transfer unit, and the fixing unit being contained in the housing device, wherein the object is the image-forming unit.

4. The housing device according to claim 1, wherein the support structure includes:

an insertion hole provided on a side of the housing on which the opening is provided, the insertion hole extending along the direction of insertion; and a bent portion constituted of one end portion of the guide member in the longitudinal direction that is bent to extend in a direction intersecting with the longitudinal direction, the bent portion being formed with an engagement protrusion that is inserted into the insertion hole.

5. An image-forming apparatus comprising:

the housing device according to claim 4;

an image-forming unit having an image-holding member on which an image is formed;

a transfer unit that transfers the image formed on the image-forming unit onto a recording medium; and a fixing unit that fixes the transferred image onto the recording medium, the image-forming unit, the transfer unit, and the fixing unit being contained in the housing device, wherein the object is the image-forming unit.

6. The housing device according to claim 1, wherein the support structure includes:

an engagement protrusion provided on a side of the housing on which the opening is provided, the engagement protrusion extending outwardly along the direction of insertion; and a bent portion constituted of one end portion of the guide member in the longitudinal direction that is bent to extend in a direction intersecting with the longitudinal direction, the bent portion being formed with an insertion hole into which the engagement protrusion is inserted.

7. An image-forming apparatus comprising:

the housing device according to claim 6;

an image-forming unit having an image-holding member on which an image is formed;

a transfer unit that transfers the image formed on the image-forming unit onto a recording medium; and a fixing unit that fixes the transferred image onto the recording medium, the image-forming unit, the transfer unit, and the fixing unit being contained in the housing device, wherein the object is the image-forming unit.

8. An image-forming apparatus comprising:

the housing device according to claim 1;

an image-forming unit having an image-holding member on which an image is formed;

a transfer unit that transfers the image formed on the image-forming unit onto a recording medium; and a fixing unit that fixes the transferred image onto the recording medium, the image-forming unit, the transfer unit, and the fixing unit being contained in the housing device, wherein the object is the image-forming unit.

9. The housing device according to claim 1, wherein the cover is provided with a receptacle for an end of the object, and wherein when the cover closes the opening, the end of the object is inserted into the receptacle of the cover, thereby supporting the object such that the object is spaced apart from the guide member by a clearance.

10. The housing device according to claim 1, wherein the support structure supports the guide member so as to be moveable slidably with respect to the housing in the longitudinal direction.

11. The housing device according to claim 1, wherein the cover is a separate member from the guide member, and the guide member is moveable with respect to the housing in the longitudinal direction in a state where the cover has closed the opening.

* * * * *